US006653638B2

(12) United States Patent
Fujii

(10) Patent No.: US 6,653,638 B2
(45) Date of Patent: Nov. 25, 2003

(54) ION GENERATING APPARATUS

(75) Inventor: Kentaro Fujii, Osaka (JP)

(73) Assignee: Keyence Corporation, Osaka (JP)

( * ) Notice: Subject to any disclaimer, the term of this patent is extended or adjusted under 35 U.S.C. 154(b) by 78 days.

(21) Appl. No.: 09/999,835

(22) Filed: Oct. 26, 2001

(65) Prior Publication Data

US 2002/0130269 A1 Sep. 19, 2002

(30) Foreign Application Priority Data

Mar. 15, 2001 (JP) ..... P.2001-073706

(51) Int. Cl.[7] ..... H05G 3/00

(52) U.S. Cl. ..... 250/423 R; 250/324; 250/325; 250/326; 250/423; 361/230; 361/231; 317/4

(58) Field of Search ..... 250/423 R, 324, 250/325, 326, 423; 361/231, 230; 317/4

(56) References Cited

U.S. PATENT DOCUMENTS 3,873,835 A * 3/1975 Ignatjev ..... 250/324
5,509,843 A * 4/1996 Akama ..... 445/50
5,789,749 A * 8/1998 Breton ..... 250/324

* cited by examiner

*Primary Examiner*—John R. Lee
*Assistant Examiner*—Zia R. Hashmi
(74) *Attorney, Agent, or Firm*—Kilyk & Bowersox, P.L.L.C.

(57) ABSTRACT

In an ion generating apparatus, an electric field for generating ion is obtained between an electrode needle 3 and a counter electrode plate 4. A surface discharge path A (passing through an air discharge port 13*a*) which has the shortest distance between the electrode needle 3 and the counter electrode plate 4 and a surface discharge path B (not passing through the air discharge port 13*a*) are created. Distances of the surface discharge paths A and B are substantially enlarged by means of two flanges 17 provided on a sleeve 906 and a flange 19 provided on an end of an outer cylindrical portion of an electrode unit 8.

10 Claims, 7 Drawing Sheets

ION GENERATING APPARATUS

BACKGROUND OF THE INVENTION

1. Field of the Invention

The present invention relates to an ion generating apparatus, and more particularly to anion generating apparatus which is capable of effectively generating ions.

2. Description of the Related Art

The ion generating apparatus is an apparatus for ionizing air particles by generating an electric field around an electrode needle to which an electric voltage has been applied. The generated ion is used for the elimination of electrical charges on an electrically charged object or in the atmosphere. In order to generate the electric field in cooperation with the electrode needle, the ion generating apparatus includes a grounded metal or another electrode applied with counter polarity as a counter electrode.

In order to obtain a sufficient amount of ions, it is necessary for the ion generating apparatus to generate a strong electric field. As a method for obtaining the strong electric field, the counter electrode may be arranged in proximity to the electrode needle. However, this has been a problem incases where a distance between the counter electrode and the electrode needle is too small, because the counter electrode may be short circuited, and thus a sufficient amount of ions cannot be obtained.

In view of the above, the distance between the electrode needle and the counter electrode must be maintained in such a condition that the above-described short circuit will not happen. However, in cases where the electrode needle is protruded from a body of the ion generating apparatus sufficiently to ensure the distance from the counter electrode, this will lead to upsizing of the ion generating apparatus.

In general, when the ion generating apparatus is used for elimination of electric charge on an electrically charged object, the ion generating apparatus is used together with a down flow apparatus. The down flow apparatus generates downward air streams so that the generated ions may rapidly reach the electrically charged object. However, there has been a problem in that the upsized ion generating apparatus may disturb the air streams flowing from the down flow apparatus and decrease the flow rate of the air streams.

There has been another problem in that the ion generating apparatus is, in many cases, exposed to dust contained in the air streams from the down flow apparatus and contaminants such as water due to humidity in a factory. In such cases, the dust and water may adhere to the electrode needle which projects from the body of the ion generating apparatus and the counter electrode. Therefore, short circuiting can easily occur between the electrode needle and the counter electrode for generating the electric field, and thus the electric field sufficient for generating ions cannot be obtained.

SUMMARY OF THE INVENTION

In view of the above, it is a first object of the invention to provide an ion generating apparatus in which an electric field sufficient for generation of ions can be obtained between the electrode needle and the counter electrode, and at the same time, a short circuit can be prevented.

It is a second object of the invention to provide an ion generating apparatus which is made compact.

The above-mentioned objects can be achieved by providing an ion generating apparatus for generating ions by ionizing gas particles, according to the invention, comprising:

an electrode needle supplied with electric voltage for generating ions;

an electrode holding part made of insulating material, for holding said electrode needle so that a distal end portion of said electrode needle is in an exposed state;

a body part made of an insulating material, for supporting said electrode holding part projecting from one side face of said body part, said body part including a voltage supply section for supplying the electric voltage to said electrode needle; and a counter electrode disposed on the one side face of said body part where said electrode needle exists so that at least a portion of said counter electrode is in contact with said body part, wherein at least one of said body part and said electrode holding part has a surface discharge restraining part in a convex or concave shape for restraining surface discharge along a surface discharge path created between said electrode needle and said counter electrode through said electrode holding part.

Here, the surface discharge, which is also called creepage discharge, means discharge (or current leakage) may occur along the surface of the electrode holding part made of insulating material or the body part made of the insulating material between the electrode needle and the counter electrode.

According to the invention, because the electrode holding part between the electrode needle and the counter electrode is provided with the surface discharge restraining part in a convex or concave shape for restraining the surface discharge, the surface discharge distance is substantially enlarged. Accordingly, the electric field sufficient for generation of ions can be obtained between the electrode needle and the counter electrode, and at the same time, a short circuit can be prevented. In addition, because the ion generating apparatus can be made compact, it will be possible to conduct effective generation of ions.

In the above-mentioned ion generating apparatus, it is preferable that the electrode holding part is in a substantially cylindrical shape extending along an axial direction of the electrode needle, and the surface discharge path includes a path from the distal end portion of the electrode needle to the counter electrode through a peripheral face of the cylindrical electrode holding part.

With such a structure, and because the electrode holding part may be in a substantially cylindrical shape, and the surface discharge path includes the path from the distal end portion of the electrode needle to the counter electrode through the peripheral face of the cylindrical electrode holding part, the electric field sufficient for generation of ion can be obtained between the electrode needle and the counter electrode, and at the same time, a short circuit can be prevented. In addition, because the ion generating apparatus can be made compact, it will be possible to conduct effective generation of ions.

Further, in the above-mentioned ion generating apparatus, it is preferable that the surface discharge restraining part is integrally provided on the peripheral face of the cylindrical electrode holding part, and has the convex or concave shape extending in a circumferential direction of the electrode holding part.

With this structure, and because the surface discharge between the electrode needle and the counter electrode will be effectively restrained, the electric field sufficient for the generation of ions can be obtained, and at the same time, a short circuit can be prevented. In addition, because the ion generating apparatus can be made compact, it will be possible to conduct effective generation of ion.

In the above-mentioned ion generating apparatus, it is also preferable that the counter electrode is attached to the body part at a position apart from a support position in the body part for supporting the electrode holding part while being disposed close to the electrode holding part keeping such a spatial distance between them that the counter electrode can generate an electric field for generating ions in cooperation with the electrode needle.

With this structure, and because the surface discharge between the electrode needle and the counter electrode and atmospheric discharge between the electrode needle and the electrode holding part can be restrained, the electric field sufficient for generation of ions can be obtained, and at the same time, a short circuit can be prevented. In addition, because the ion generating apparatus can be made compact, it is possible to conduct effective generation of ions.

Further, in the above-mentioned ion generating apparatus, it is preferable that the spatial distance is such a distance that atmospheric discharge is restrained between the surface discharge restraining part of the electrode holding part and the counter electrode.

With this structure, and because the atmospheric discharge is restrained between the surface discharge restraining part of the electrode holding part and the counter electrode, the electric field sufficient for the generation of ions can be obtained, and at the same time, a short circuit can be prevented. In addition, because the ion generating apparatus can be made compact, it will be possible to conduct effective generation of ion.

Further, in the ion generating apparatus, it is preferable that the body part is in a shape of an elongated bar, and provided with a plurality of the electrode holding parts spaced from each other in a longitudinal direction thereof.

In this structure, and because the plurality of electrode holding parts are spaced from each other so as to form a certain width, electrical charges on an electrically charged object having a considerable width can be effectively eliminated.

Further, in the above-mentioned ion generating apparatus, it is preferable that the counter electrode includes a plurality of openings through which the electrode holding parts can independently protrude, and the spatial distance is the shortest distance between circumferential edges of the openings and the electrode holding parts protruding from the openings.

With this structure, and because the counter electrode includes a plurality of openings, and the spatial distance is the shortest distance between the circumferential edges of the openings and the electrode holding parts protruding from the openings, the electric field sufficient for the generation of ions can be obtained, and at the same time, a short circuit can be prevented. In addition, because the ion generating apparatus can be made compact, it is possible to conduct the effective generation of ions.

In the above-mentioned ion generating apparatus, it is also preferable that the counter electrode consists of a metal plate having a substantially U-shape cross section and having substantially the same length as the body part in the elongated bar shape, and both sides of the metal plate in the U-shape are in contact with the body part.

With this structure, and because the counter electrode consists of a metal plate with a U-shape cross section, and an open edge of the U-shape is in contact with longitudinal edges of the body part, the electric field sufficient for the generation of ions can be obtained, and at the same time, a short circuit can be prevented. In addition, because the ion generating apparatus can be made compact, it is possible to conduct the effective generation of ions.

In short, as disturbance of the air streams for allowing the generated ions to reach the electrically charged object by means of a down flow apparatus can be restrained to a minimum extent and thus sufficient ions can reach the electrically charged object, effective elimination of electrical charges can be attained.

DETAILED DESCRIPTION OF THE PREFERRED EMBODIMENTS

A general structure of the ion generating apparatus will be described referring to FIGS. 1 and 2. A structure of an electrode holding bar will be described referring to FIG. 3.

Figure 1:
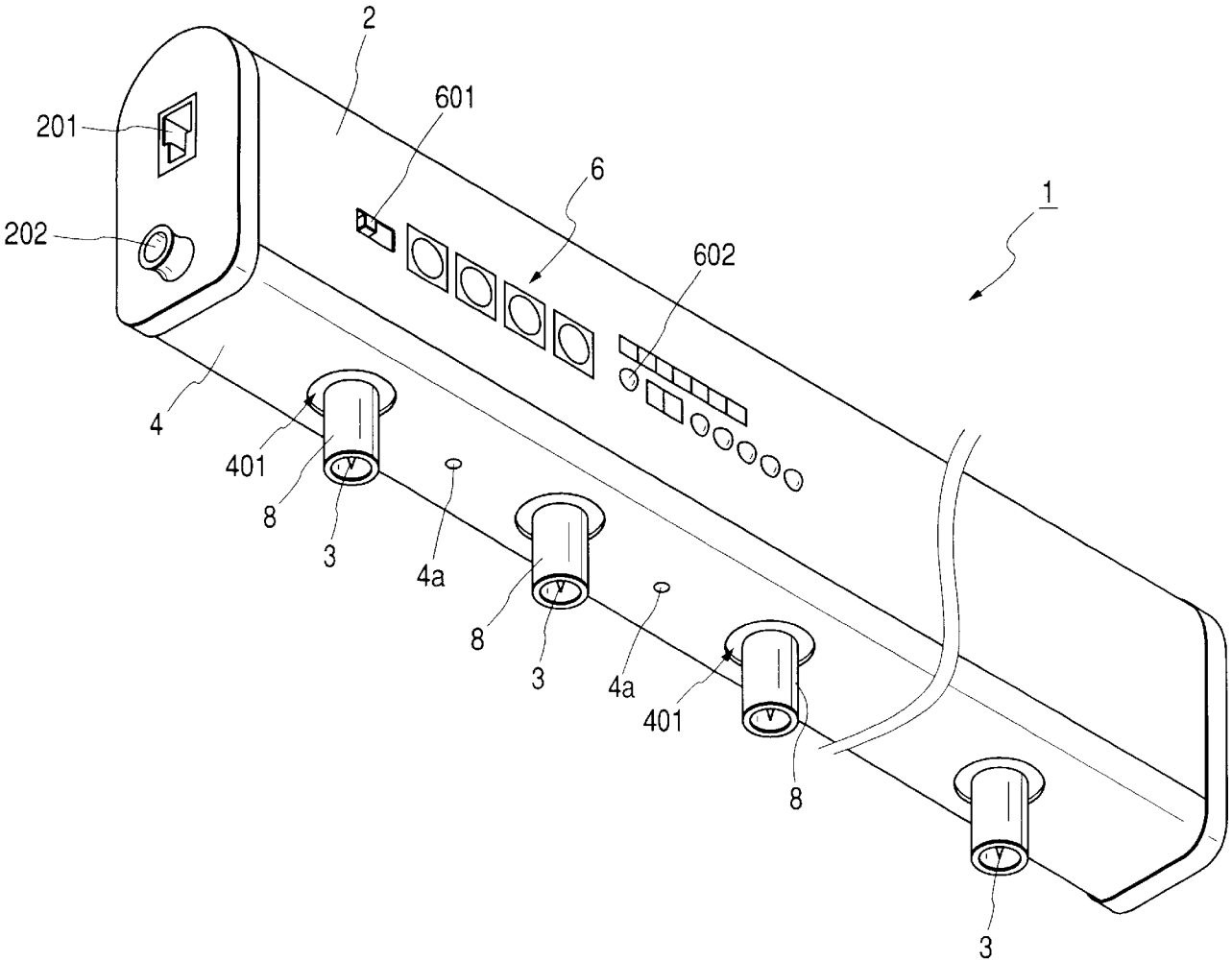
FIG. 1 is a perspective view showing a general structure of an ion generating apparatus according to the invention.
Figure 3:
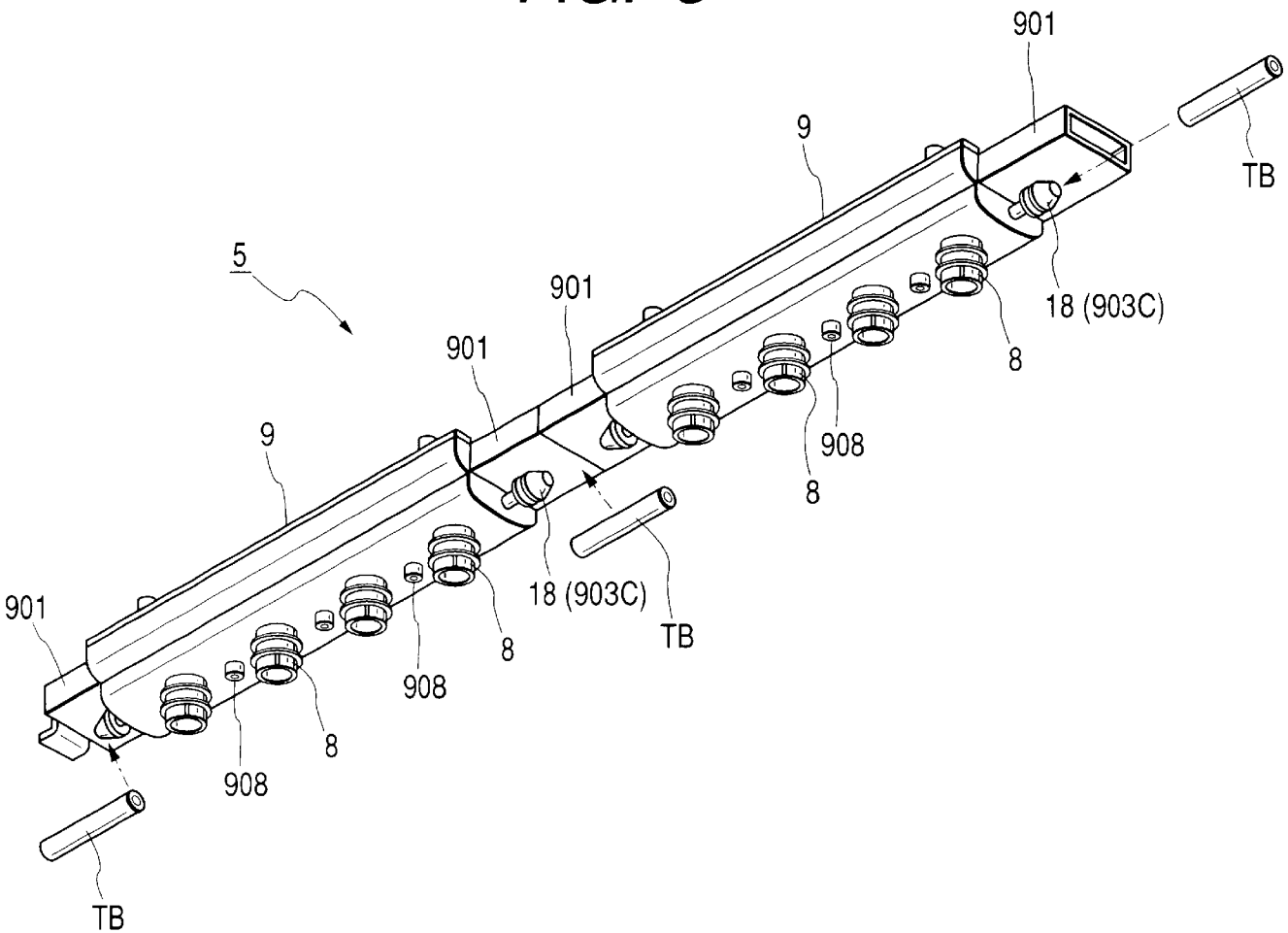
FIG. 3 is a perspective view of an electrode holding bar included in the ion generating apparatus of FIG. 1.

FIG. 1 is a perspective view of an ion generating apparatus (ESE) 1. The ion generating apparatus 1 includes a body case 2, a counter electrode plate 4, and electrode holding bars 5 (FIG. 3). The body case 2 incorporates electric components which are necessary for the generation of ions. The counter electrode plate 4 has a potential difference with respect to electrode needles 3. The electrode holding bar 5 (FIG. 3) holds the electrode needles 3.

The body case 2 has an outer profile of an elongated bar in a substantially inverted U-shape, and is made of insulating material. The electrode needles 3 for generating ions are arranged along a longitudinal direction of the body case 2 in a spaced relation to each other. The inside of the body case 2 is hollow for incorporating the electric components which are necessary for the generation of ions. An operating section 6 is disposed on an outer face of the body case 2. The operating section 6 includes a trimmer 601 to adjust the generation frequency of positive ions or negative ions, an abnormal discharge alarm LED 602, and the like (FIG. 1).

Figure 2:
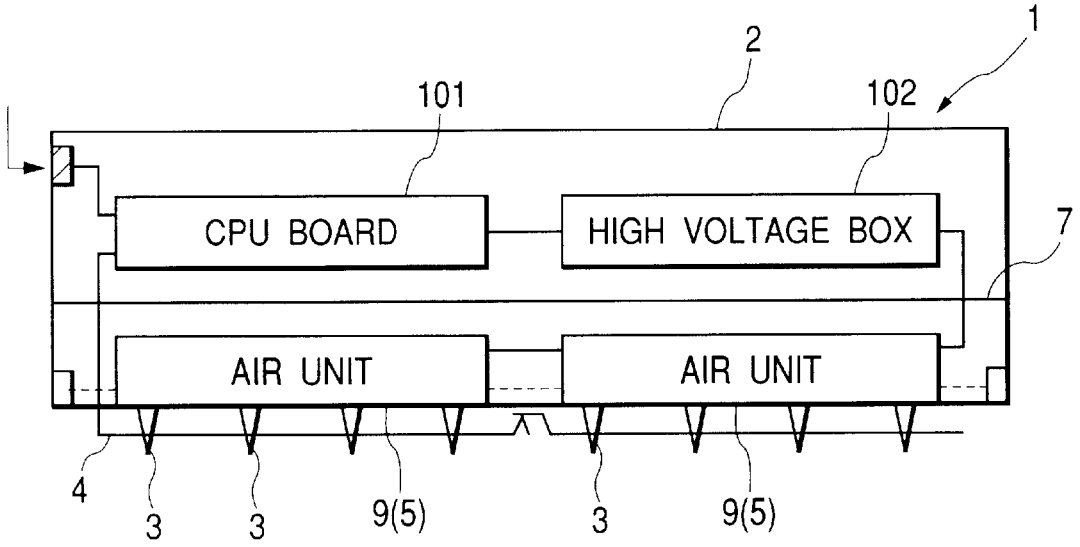
FIG. 2 is a schematic view of the structure of the ion generating apparatus according to the invention.

FIG. 2 schematically shows a structure of an interior of the body case 2. In FIG. 2, the body case 2 has a partition plate 7 inside. In an upper area above the partition plate 7, there are provided a CPU board 101 and a high voltage box 102. The CPU board 101 is supplied with electric power from outside and control indications concerning a power supply circuit and an operation system. The high voltage box 102 is electrically connected to the CPU board and is used for increasing voltage up to a high voltage necessary for the generation of ions. In a lower area below the partition plate 7 in the body case 2, there are provided the above described two electrode holding bars 5. Each of the electrode holding bar 5 includes electrode units 8 (FIG. 4), and an air unit 9. Air streams for air purging which will be described below is introduced via the air unit 9. In this embodiment, each of two electrode holding bars 5 is provided with four sets of the electrode units 8. The two electrode holding bars 5 are connected to each other by means of an air supply tube or the like.

One of the two electrode holding bars 5 is directly connected to the high voltage box 102, and the other electrode holding bar 5 is indirectly connected to the high voltage box 102 via the one electrode holding bar 5.

As mentioned above, the interior of the body case 2 is divided by means of the partition plate 7 into an upper area where high voltage is generated, and an lower area where ions are generated and air is supplied to a vicinity of the electrode needles. Therefore, the insulating performance between both of the areas can be improved, and a short circuit that causes detrimental effects on the electric field for the generation of ions can be prevented.

Referring back to FIG. 1, the counter electrode plate 4 consists of an elongated plate with a substantially U-shape cross section which is made of electrically conductive material such as stainless steel, for example. The counter electrode plate 4 covers a lower end opening of the body case 2. The counter electrode plate 4 preferably has eight circular openings 401 at positions corresponding to the eight electrode units 8. Each of the electrode units 8 is exposed to the exterior through each of the circular openings 401. Since a diameter of the circular opening 401 is substantially larger than an outer diameter of the electrode unit 8, a gap is formed between a circumferential edge of the circular opening 401 and an outer profile of the electrode unit 8. The counter electrode plate 4 is grounded so as to have a potential difference with respect to the electrode needles 3 in order to generate the electric field for the generation of ions. The counter electrode plate 4 may be composed of a pair of plates in which each of the plates extends along one of the side edges at a lower end of the body case 2, and suspend downward from the one of the side edges, preferably having a curved cross section protruding outward so that the pair of the plates may approach each other. In short, the pair of plates may be in such a shape so as to form an oval shape in cross section in cooperation with the body case 2.

The body case 2 is provided at its end face with a modular connector 201 and an air supply inlet 202. The modular connector 201 supplies power to the CPU board 101 and the high voltage box 102, and are connected to another ion generating apparatus to exchange communication signals. The air supply inlet 202 introduces air streams for air purging.

Figure 4:
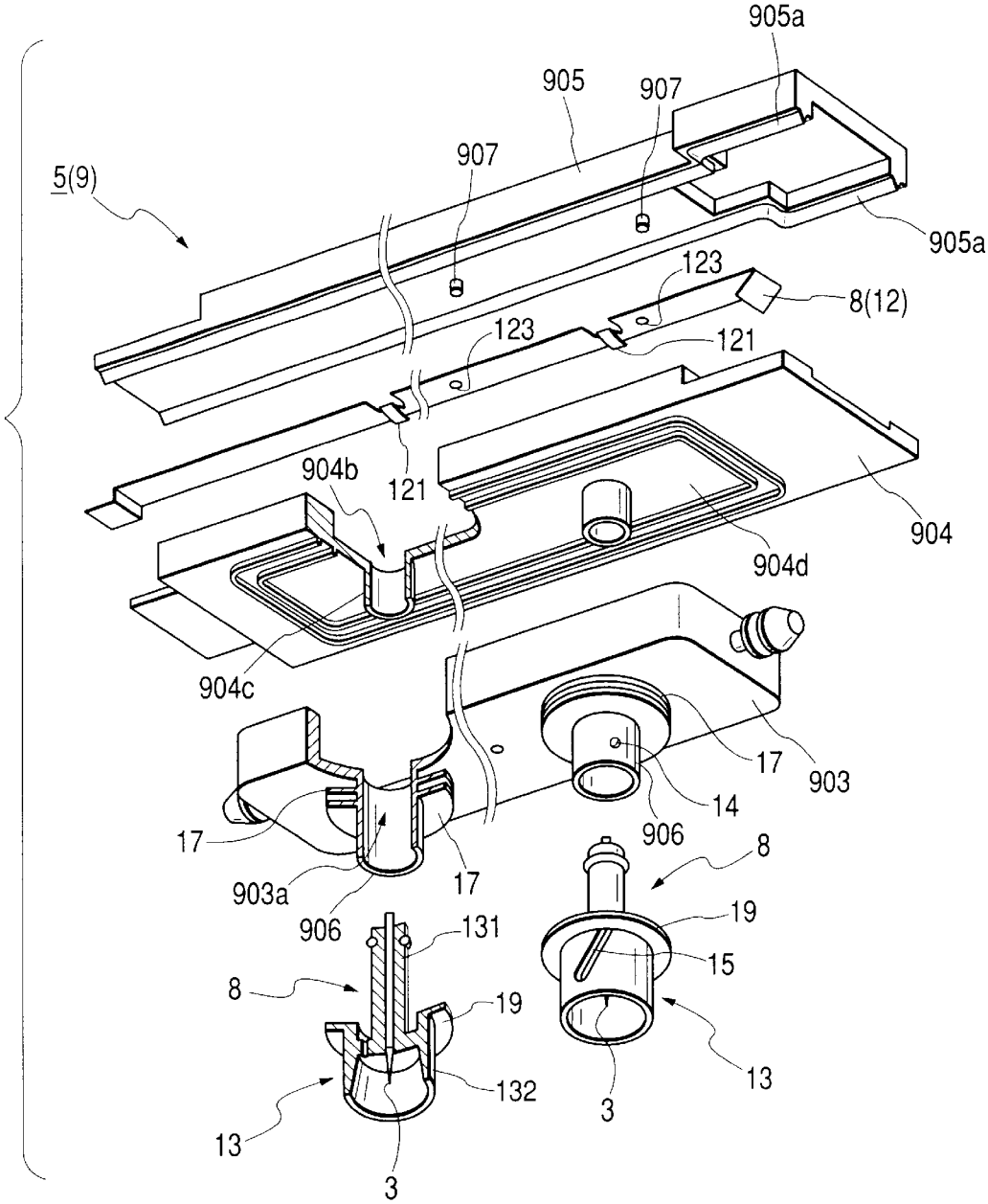
FIG. 4 is an exploded perspective view of the electrode holding bar.

Referring to FIGS. 3 and 4, the electrode holding bar 5 will be described.

As shown in FIG. 3, the electrode holding bar 5 includes the electrode units 8 which hold the electrode needles 3, and the air unit 9 capable of holding a plurality of the electrode units 8.

End portions 901 of the air unit 9 have connector structures for supplying electric voltage from the high voltage unit 102. In addition, the end portions 901 have an extension function which can couple adjacent air units 9, 9 by engaging the end portions 901 of the adjacent air units 9 with each other. By means of these extension functions, a desired number of the common air units 9 can be joined according to a length of the elongated body case 2 so that a desired length of the ion generating apparatus can be obtained. Further, by bending or folding both ends of a high voltage plate 12 which will be described below to form contact portions, sufficient contact pressure between the adjacent high voltage plates 12 can be obtained.

As shown in FIG. 4, the air unit 9 included in the electrode holding bar 5 has an air passage forming part 903, a contact supporting part 904, and a high voltage plate supporting part 905 for supporting the high voltage plate 12. The electrode unit 8 is composed of an assembly consisting of the electrode needle 3 and a cap 13 (FIG. 4). The cap 13 has a cylindrical holding portion 131, and an outer cylindrical portion 132. The cylindrical holding portion 131 surrounds a body portion of the electrode needle 3 except a distal end and a backward end. The outer cylindrical portion 132 surrounds the distal end of the electrode needle 3. The caps 13 are detachable with respect to sleeves 906 which are arranged along a longitudinal direction of the air unit 9 spaced from each other.

The sleeve 906 of the air unit 9 is provided with a projection 14 around its outer periphery. On the other hand, the outer cylindrical portion 132 of the cap 13 is provided with a diagonal slit 15 diagonally extending from its back end toward its distal end. By pushing the electrode unit 8 (cap 13) into the sleeve 906 while aligning the diagonal slit 15 with the projection 14, the electrode unit 8 enters deep into a base end of the sleeve 906 while rotating through guiding action of the diagonal slit 15 and the projection 14 which have been engaged with each other. Thus, the electrode unit 8 can be positioned. This will facilitate exchanging parts of the electrode unit 8 including the electrode needle 3 when the electrode needle 3 is damaged or worn due to aging and sufficient generation of ions cannot be expected.

The air unit 9 includes the high voltage plate 12, the high voltage plate supporting part 905, the contact supporting part 904, and the air passage forming part 903. The contact supporting part 904 and the high voltage plate supporting part 905 clamp the high voltage plate 12 between them. The air passage forming part 903 forms an air passage F (FIG. 5) for introducing air streams for air purging. The high voltage plate supporting part 905, the contact supporting part 904 and the air passage forming part 903 may be formed of insulating material such as polystyrene, for example, and preferably may be joined together by ultrasonic welding or the like. In the case of joining them by welding, it is preferable that two components to be welded are formed of same material, because weldability is favorable between the components of the same material.

Figure 5:
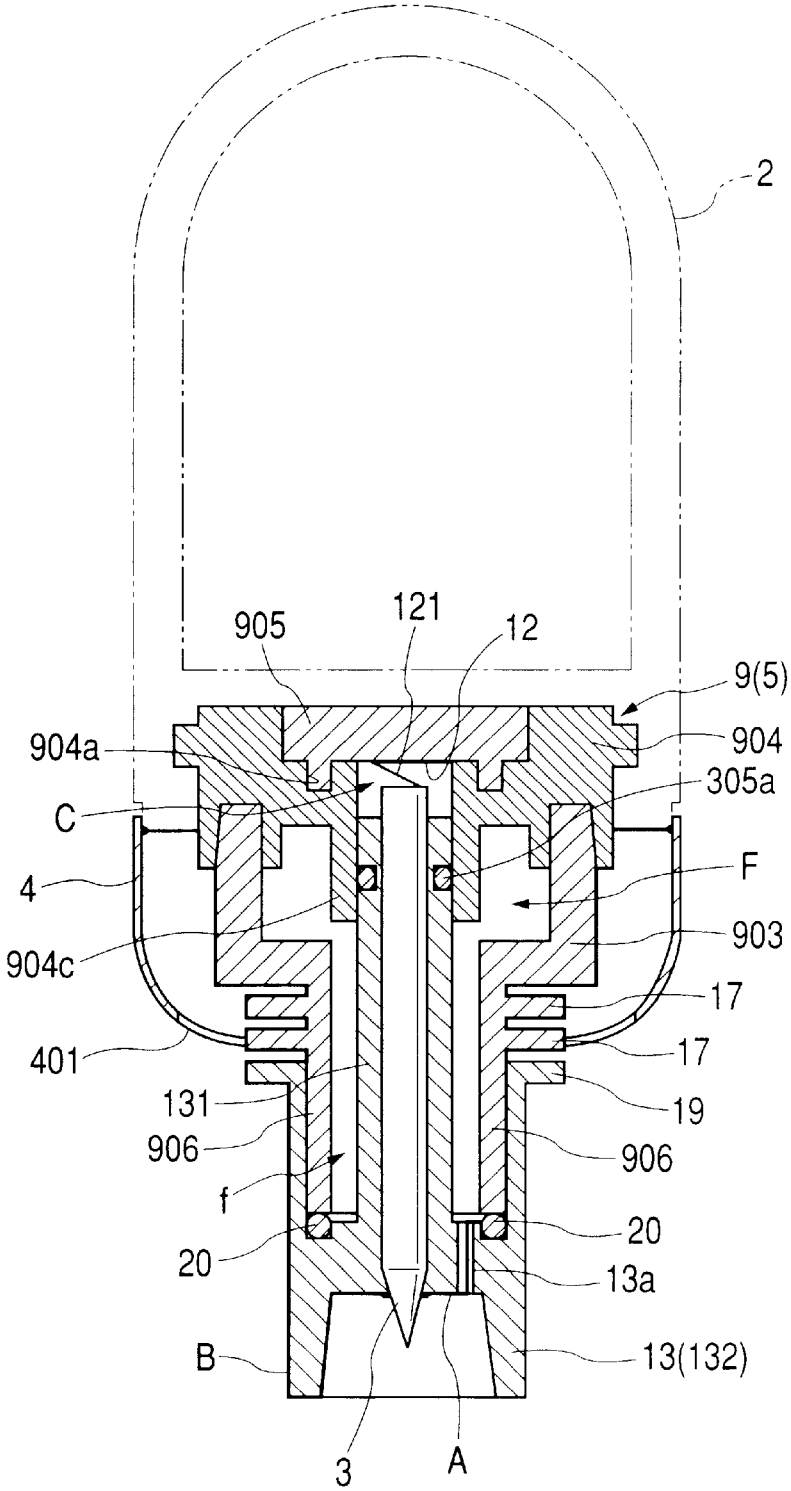
FIG. 5 is a sectional view of an essential part of the invention.

The high voltage plate 12 is in a form of a strip-like thin plate, that is, a web made of stainless steel. A contact portion of the high voltage plate 12 with respect to the electrode needle 3 has a spring-shaped structure formed by folding a projected piece 121 which is formed by cutting out a part of the high voltage plate so as to ensure contact pressure with respect to the electrode needle 3 (FIGS. 4 and 5). There are provided a plurality of the projected pieces 121 for the respective electrode units 8 at positions corresponding to the electrode units 8.

The high voltage plate supporting part 905 has a groove shape extending in a longitudinal direction which can receive the high voltage plate 12. The high voltage plate supporting part 905 is provided with small projections 907 spaced from each other. The high voltage plate 12 is provided with small holes 123 correspondingly to the small projections 907, and the high voltage plate 12 can be positioned by inserting the small projections 907 into the small holes 123. The high voltage plate supporting part 905 is provided at its lower face with ribs 905*a* extending along both sides thereof in a longitudinal direction, and can be joined to the contact supporting part 904 which will be described below, by means of these ribs 905*a*.

The contact supporting part 904 has an elongated shape in a longitudinal direction in order to clamp the high voltage plate 12 in cooperation with the high voltage plate supporting part 905. The contact supporting part 904 also has a support structure for supporting the contact portions between the electrode needles 3 of the electrode units 8 and the high voltage plate 12.

The contact supporting part 904 has grooves 904*a* for receiving the ribs 905*a* of the high voltage plate supporting part 905 on a face to be mated with the high voltage plate supporting part 905 (FIG. 5). The contact supporting part 904 has circular openings 904*b* which surround respective contact portions between the electrode needles 3 and the high voltage plate 12. Circumferential edges of the circular openings 904*b* are continued into sleeves 904*c* which extend downward (FIG. 4). There are provided a plurality of openings 904*b* and the sleeves 904*c* at a same interval as the projected pieces 121 of the high voltage plate 12. The contact supporting part 904 is provided at its lower face with a recess 904*d* which forms the air passage F in cooperation with the passage forming part 903 which will be described below.

The contact supporting part 904 and the passage forming part 903 can be joined together by an ultrasonic welding method. Since there exists no different material on these parts to be welded, the interface between the contact supporting part 904 and the passage forming 903 will disappear. Accordingly, the high voltage plate 12 is contained in a substantially air tight space which has been formed by integrally forming the high voltage plate supporting part 905 and the contact supporting part 904. As a result, the insulation level of the high voltage plate 12 with respect to the exterior can be improved, and the surface discharge of the high voltage plate 12 can be restrained.

The passage forming part 903 is in a shape of a box which opens upward in order to form the air passage F in cooperation with the recess 904*d* provided in the contact supporting part 904. The passage forming part 903 is provided with a plurality of insertion holes 903*a* adapted to receive the electrode units 8 (FIG. 4) a long its longitudinal direction. The passage forming parts 903 are arranged at the same interval as the openings 904*b* of the contact supporting part 904. Ends of the insertion holes 903*a* continued into sleeves 906 extending downward. Each of the sleeves 906 is formed, near a base end of the sleeve 906, with two pleat-shaped flanges 17 which are apart from each other in joints 18 are fitted to the openings 903*c* (not shown in FIG. 3). To the air joints 18, rubber tubes TB to be used when a plurality of the air units 9 are additionally provided as shown in FIG. 3 are connectable.

As described above, the contact supporting part 904 and the passage forming part 903 can be joined together by an ultrasonic welding method in the same manner as the high voltage supporting part and the contact supporting part as described above, and so, the surface discharge of the high voltage plate 12 can be restrained.

Threaded holes 908 (FIG. 3) formed in the air unit 9 are used for fixing the counter electrode plate 4 as shown in FIG. 1 by threading small screws (not shown) passed through the holes 4*a* of the counter electrode plate 4.

FIG. 5 is a sectional view showing the electrode needle 3 projected from the body case 2 which includes the counter electrode plate 4, and assembly of the electrode holding bar 5 holding the electrode needle 3 and the counter electrode plate 4.

The ion generating apparatus 1 has an oval shape in cross section consisting of the body case 2 and the counter electrode plate 4 so that the air streams from the down flow apparatus not shown in the drawings is not weakened nor disturbed.

The electrode needle 3 is in a shape of a needle made of tungsten, stainless steel or silicone. A distal end of the plate 4 so that the air streams from the down flow apparatus not shown in the drawings is not weakened nor disturbed.

The electrode needle 3 is in a shape of a needle made of tungsten, stainless steel or silicone. A distal end of the electrode needle 3 may preferably have a radius of 0.5 mm or less so as to effectively generate ions. The cap 13 includes the cylindrical holding portion 131 and the outer cylindrical portion 132. The holding portion 131 supports the electrode needle 3 in such a manner that the distal end of the electrode 3 is exposed therefrom. The holding portion 131 extends along the electrode needle 3 up to near a backend portion of the electrode needle 3. The outer cylindrical portion 132 is integrally formed with the holding portion 131. Preferably, the cap material is excellent in resistance to surface discharge. In short, material having a larger CTIvalue may be employed as material for the cap 13. CTI is a standard measure of the voltage which causes tracking after 50 drops of 0.1 percent ammonium chloride solution have fallen on the identified material.

The counter electrode plate 4 which has been fixed to the air unit 9 by means of the threaded holes 908 (FIG. 3) of the air unit 9 is in contact with both side edges of the body case 2 beside the threaded holes 908. The contacted portions of the body case and the counter electrode plate 4 are preferably flush so as not to disturb the air streams from the down flow apparatus.

The counter electrode plate 4 in this embodiment has a function of generating the above described electrical field for the generation of ions as well as a function of feeding back electric current flowing through the counter electrode plate 4 to the CPU board 101 in order to optimize the balance of the generated ions and an amount of the ions which has reached an electrically charged object.

By fixing the electrode unit 8 to the air unit 9, a surface discharge path A which has the shortest distance between the electrode needle 3 and the counter electrode plate 4 (via an air discharge port 13*a*), and a surface discharge path B (not passing through the air discharge port 13*a*) are generated as shown in FIG. 5. Distances of the surface discharge paths A and B are set to be such distances as ensuring that surface discharge is restrained (hereinafter referred as surface discharge distance), by means of the aforesaid two flanges 17 formed on the sleeve 906 and a flange 19 formed on an end of the outer cylindrical portion of the electrode unit 8. Thus, the surface discharge when dust or water has adhered to the outer cylindrical portion 132 can be prevented. The surface discharge distance in which the surface discharge is restrained can be determined based on the material used in forming the surface along which the surface discharge may occur, and the electric voltage supplied to the material. The surface discharge distance is also called creepage distance. (Hereinafter this distance is referred as surface discharge distance in this specification.)

Since the flanges 17 are provided along an entire circumference of the outer face of the sleeve 906, the surface discharge can be restrained in all directions. By providing the flange 19 at the end of the outer cylindrical portion 132 of the electrode unit 8 in addition to the flanges 17 of the sleeve 906, the surface discharge path B which does not pass through the air discharge port 13*a* can be enlarged. Further, because the flanges 17 are formed near the base end of the sleeve 906 so that a projected amount of the electrode unit 8 from the ion generating apparatus 1 may be reduced, the size of the ion generating apparatus 1 in a vertical direction can be minimized. Still further, because the flanges 17 are preferably in the shape of pleats (or convex or concave shape) perpendicularly extending with respect to the peripheral face of the sleeve 906, the size of the ion generating apparatus 1 in a lateral direction can be minimized as compared with a case where the flanges 17 are formed on the face extending laterally. In short, the ion generating apparatus which is small and compact in general can be realized. Thus the down flow air streams passing around the ion generating apparatus 1 will be prevented from being weakened and disturbed.

For example, flanges 17 in FIG. 5 refer to a convex or concave shave for restraining surface discharge along a surface discharge path created between the electrode needle and the counter electrode through electrode holding part.

The circular opening 401 of the counter electrode plate 4 has a diameter larger than an outer diameter of the sleeve 906 of the air unit 9. The presence of a gap between a circumferential edge of the circular opening 401 and outer circumferential edges of the flanges 17 will prevent formation of a surface discharge path between them. This gap may be preferably set to be larger than a distance where atmospheric discharge from the outer circumferential edge of the flange 17, which is closest to the counter electrode plate 4, can be restrained. The occurrence of the atmospheric discharge depends on the voltage obtained by subtracting a voltage drop in the surface discharge path A from the electrode needle 3 to the outer circumferential edge of the flange 17 from the voltage supplied to the electrode needle 3.

When the electrode unit 8 has been fixed to the air unit 9, an air branch passage f communicating with the air passage F in the air unit 9 can be formed between the holding portion 131 of the electrode unit 8 and the sleeve 906 of the air unit 9. Air from an air source (not shown) flows through the air passage F in the air unit 9 and then the air branch passage f, and thereafter, is discharged downward from an area near the distal end of the electrode needle 3 through the air discharge port 13*a*.

As a result, the ions generated by the electric field near the distal end of the electrode needle 3 can be detached from the electric field, and the amount of the ions arriving at the electrically charged object can be increased. Moreover, when the electrode unit 8 has been assembled in the air unit 9, an O-ring 305*a* provided in a groove of the holding portion 131 is brought into contact with an interior of the sleeve 904*c* of the contact supporting part 904, to form a hermetically sealed space C. Thus, the contact portion between the electrode needle 3 and the high voltage plate 12 can be hermetically sealed. Reference numeral 20 in FIG. 5 represents another O-ring for enhancing sealing property.

Figure 6:
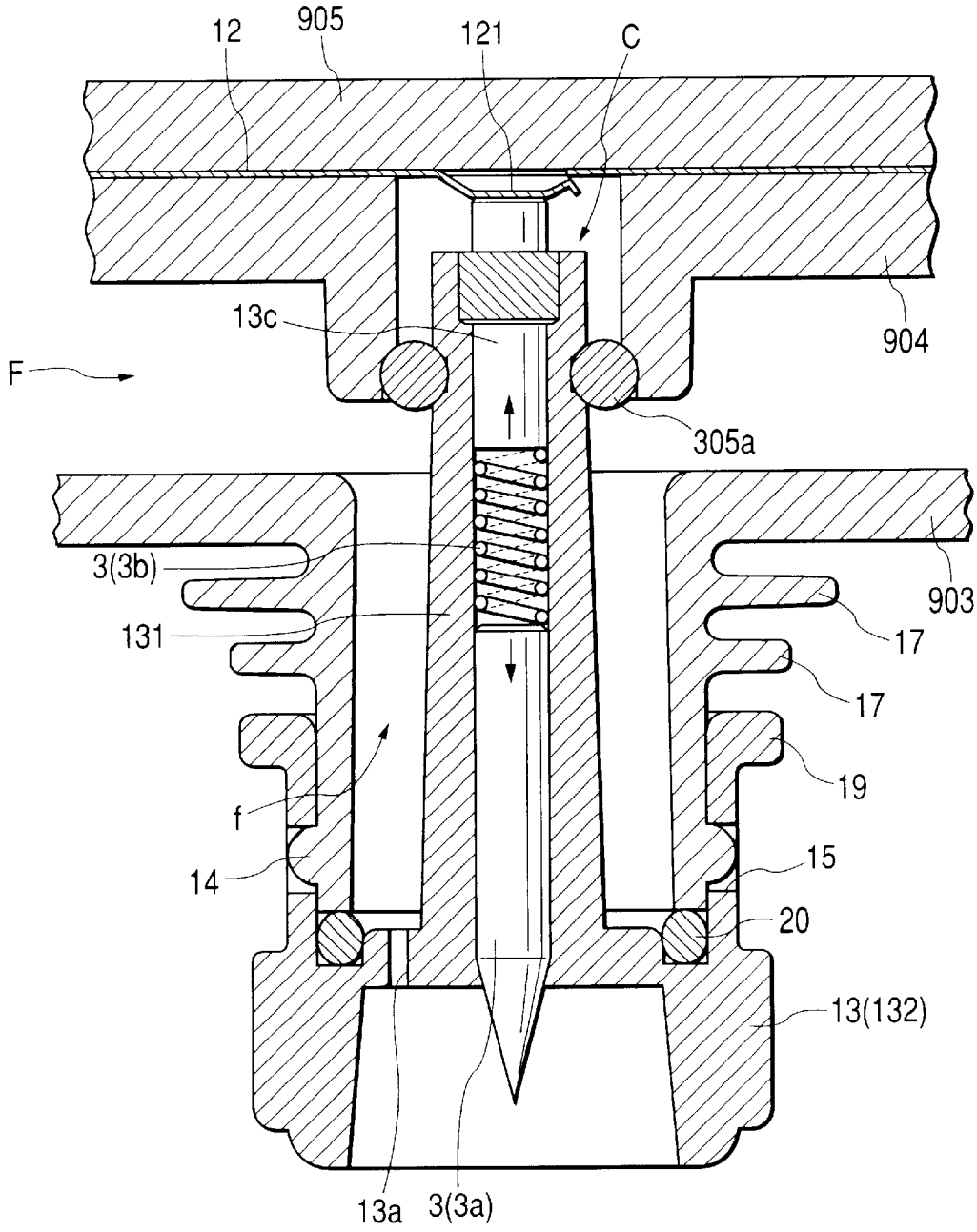
FIG. 6 is a sectional view of an electrode unit included in the invention.

In order to hold the electrode needle 3 in the electrode unit 8 silicone may be employed as the material of the electrode needle 3 as shown in FIG. 6. The electrode needle 3 can be made of a single piece of stainless steel and may be simply inserted and held by friction with respect to the holding portion 131. In consideration of fragileness of the electrode needle 3 made of silicone, the following structure can be employed for bringing it into pressure contact with the high voltage plate 12.

The electrode unit 8 of FIG. 6 is different from that of FIG. 5 in that the electrode needle 3 of the electrode unit 8 of FIG. 6 is composed of a plurality of elements. In other words, in the electrode unit 8 of FIG. 6, the electrode needle 3 includes a first electrode 3*a*, a helical spring 3*b*, and a backward end electrode 3*c*. The first electrode 3*a* is made of silicone, and has a harrow distal end portion. The backward end electrode 3*c* is a second electrode made of stainless steel and provided with a knurled part to be fixed to the holding portion 131 by caulking. The electrode needle 3 including these three elements 3*a* to 3*c* can be free from the problem that the electrode needle may be chipped, because the portion, resiliently contacting the projected piece 121 of the high voltage plate 12, is the electrode 3*c* made of stainless steel.

A method of assembling this electrode unit 8 will be described below. The first electrode 3*a* made of silicone constituting the distal end of the electrode needle is inserted into the holding portion 131 from its backward end. The tapered distal end portion of the silicone made electrode 3*a* is engaged with a tapered face formed at the distal end of the holding portion 131 and therefore the electrode 3*a* will not escape from the holding portion 131.

Then, the helical spring 3*b*, and the backward end electrode 3*c* are inserted sequentially into the holding portion 131 from its backward end. By adjusting insertion amount of the backward end electrode 3*c* to appropriately contract the helical spring 3*b*, an electrical connection between the backward end electrode 3*c* and the distal end electrode 3*a* can be ensured. The backward end electrode 3*c* is fixed to the holding portion 131 by means of the knurled part.

Although the electrode holding bar 5 has been described as an electrode holding part in this embodiment, at least the electrode unit 8 may be employed as the electrode holding part, enabling the air unit 9 to be integrally held with respect to the body case 2.

Figure 7:
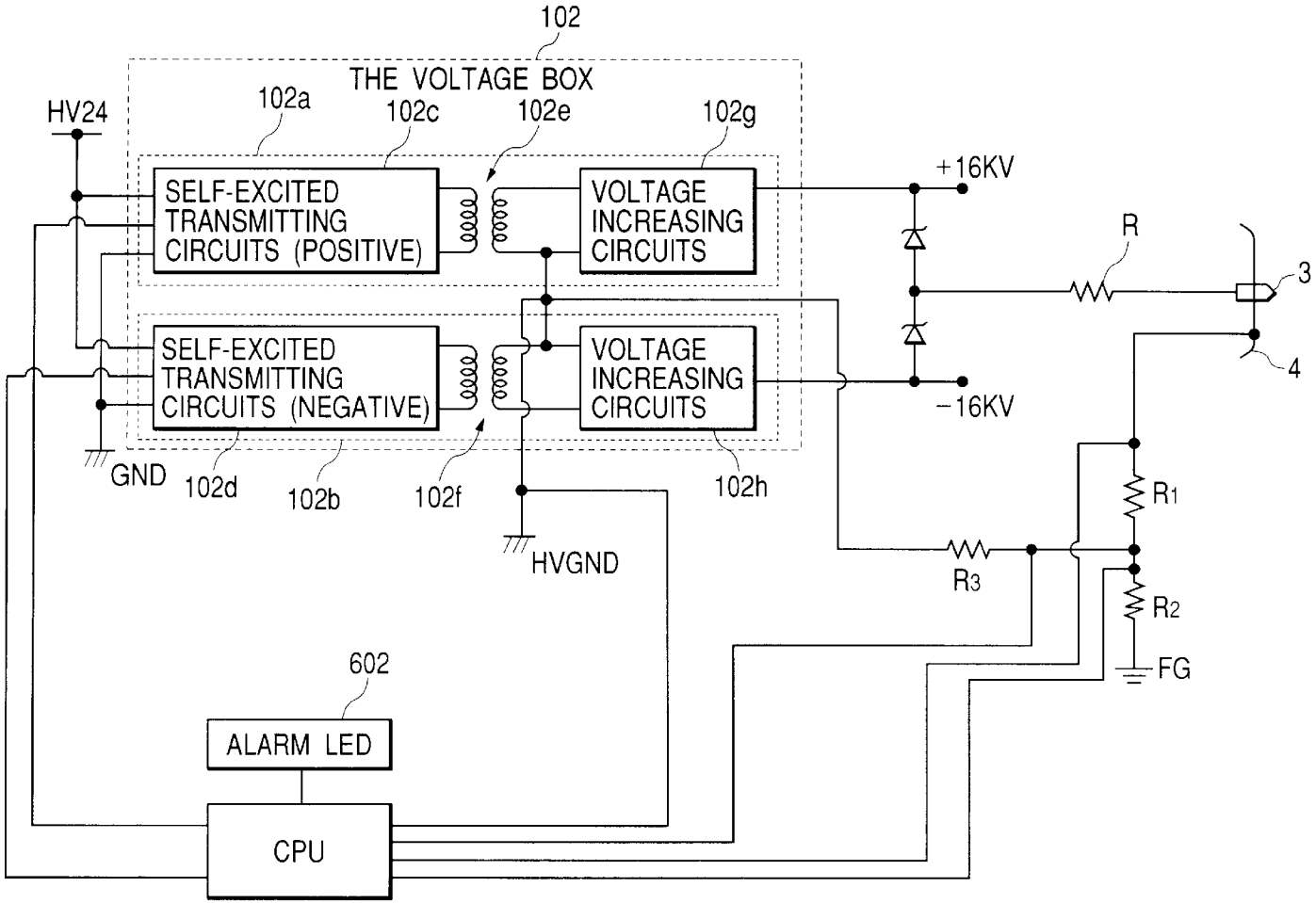
FIG. 7 is a block diagram of a circuit included in the ion generating apparatus according to the invention.

A circuit diagram in FIG. 7 shows a system for generating a pulse AC ion (alternately generating positive ion and negative ion from a same electrode needle) which is preferably employed in this embodiment.

The ion generating apparatus 1 including the electrode needle 3 has the high voltage box 102 consisting of a positive side high voltage generating circuit 102*a* and a negative side high voltage generating circuit 102*b*. Both the positive side high voltage generating circuit 102*a* and the negative side high voltage generating circuit 102*b* respectively include self-excited transmitting circuits 102*c*, 102*d*, and voltage increasing circuits 102*g*, 102*h*. The self-excited transmitting circuits 102*c*, 102*d* are respectively connected to primary coils of transformers 102*e*, 102*f*. The voltage increasing circuits 102*g*, 102*h* are respectively connected to secondary coils of the transformers 102*e*, 102*f* and are made of multiplied rectifier circuits, for example. There is provided a protective resistor R between the high voltage box 102 and the electrode needle 3.

A third resistor R3 and a second resistor R2 are connected in series between a grounded end HVGND of the secondary coils of the transformers 102*e*, 102*f* and a frame ground FG. Further, a first resistor R1 and the second resistor R2 are connected in series between the counter electrode plate 4 arranged near the electrode needle 3 and the frame ground FG.

More specifically, among the counter electrode plate 4, the frame ground FG, and the grounded end HVGND of the secondary coils of the transformers 102*e*, 102*f*, there are provided the first resistor R1 at a side of the counter electrode plate 4, the second resistor R2 at a side of the frame ground FG, and the third resistor R3 at the side of the grounded end HVGND of the secondary coils of the transformers 102*e*, 102*f*. The ion generating apparatus 1 has an abnormal discharge alarm LED 602 which has alarm means connected to the CPU board 101.

By detecting an electric current flowing through the first resistor R1, the balance of the ion generated in the vicinity of the electrode needle 3 can be detected. By detecting an electric current flowing through the second resistor R2, the balance of the ion in the vicinity of the electrically charged object can be determined. In addition, by detecting an electric current flowing through the third resistor R3, an abnormal discharge between the electrode needle 3 and the counter electrode plate 4 or the frame ground FG can be detected.

The ion generating apparatus 1 transmits the conditions of the electric current flowing through resistor R1, resistor R2, and resistor R3 to the CPU board 101, and can send a warning to an operator by means of the abnormal discharge alarm LED 602 which has the alarm means in the operating section 6 (FIG. 1).

It is to be noted that in the ion generating apparatus, which includes the electrode needle exclusively for generating positive ions and the electrode needle exclusively for generating negative ions, an SSDC (STEADY STATE DIRECT CURRENT) ion generating system in which the positive ion and the negative ion are simultaneously generated, or a pulse DC ion generating system in which the positive ion and the negative ion are alternately generated can be applied to the present invention.

The SSDC ion generating system and the pulse DC ion generating system have electrode needles which generate ions of counter polarity as a counter electrode having a potential difference with respect to the electrode needles supplied with high voltage in order to generate the electric field. However, in the pulse AC ion generating system employed according to an embodiment of the invention, the counter electrode must be separately provided.

In this case, the position of the counter electrode to be arranged with respect to the electrode needle is important in conducting the generation of ions. In the case where the counter electrode is arranged with a large distance from the electrode needle, it will result in a weak electric field and the generation of ions will be difficult. On the contrary, in the case where the distance is too small, atmospheric discharge will occur and the generation of ions will also be difficult.

Moreover, in the case where the counter electrode is arranged between the electrode needle and the electrically charged object, although ions can be generated sufficiently, the ion will be absorbed by the counter electrode before arriving at the electrically charged object. As a result, the sufficient elimination of electric charge on the electrically charged object cannot be attained. Therefore, in the pulse AC ion generating system, in order to satisfy both conditions that the electrode needle and the counter electrode are arranged close to each other so that the electric field required for the generation of ions can be generated, and that the generated ions may not be absorbed by the counter electrode before arriving at the electrically charged object, it is preferred that the counter electrode plate 4 is arranged at a position opposite to the ion radiation direction of the electrode needle 3 and at such a position that surface discharge and atmospheric discharge will not happen.

What is claimed is:

1. An ion generating apparatus for generating ions by ionizing gas particles comprising:

an electrode needle supplied with electric voltage for generating ions;

an electrode holding part made of insulating material, for holding said electrode needle so that a distal end portion of said electrode needle is in an exposed state;

a body part made of an insulating material, for supporting said electrode holding part projecting from one side face of said body part, said body part including a voltage supply section for supplying the electric voltage to said electrode needle; and a counter electrode disposed on the one side face of said body part where said electrode needle exists so that at least a portion of said counter electrode is in contact with said body part, wherein at least one of said body part and said electrode holding part has a surface discharge restraining part in a convex or concave shape for restraining surface discharge along a surface discharge path created between said electrode needle and said counter electrode through said electrode holding part.

2. The ion generating apparatus as claimed in claim 1, wherein said electrode holding part is in a substantially cylindrical shape extending along an axial direction of said electrode needle, and the surface discharge path includes a path from the distal end portion of said electrode needle to said counter electrode through a peripheral face of said cylindrical electrode holding part.

3. The ion generating apparatus as claimed in claim 2, wherein the surface discharge restraining part is integrally provided on the peripheral face of said cylindrical electrode holding part, and has the convex or concave shape extending in a circumferential direction of said cylindrical electrode holding part.

4. The ion generating apparatus as claimed in claim 1, wherein said counter electrode is attached to said body part at a position apart from a support position in said body part for supporting said electrode holding part while being disposed close to said electrode holding part, keeping such a spatial distance between them such that said counter electrode is capable of generating an electric field for generating ions in cooperation with said electrode needle.

5. The ion generating apparatus as claimed in claim 4, wherein said spatial distance is a distance such that atmospheric discharge is restrained between the surface discharge restraining part of said electrode holding part and said counter electrode.

6. The ion generating apparatus as claimed in claim 1, wherein said body part is in a shape of an elongated bar, and provided with a plurality of said electrode holding parts spaced from each other in a longitudinal direction thereof.

7. The ion generating apparatus as claimed in claim 6, wherein said counter electrode includes a plurality of openings wherein the plurality of said electrode holding parts independently protrude, and have a spatial distance between said counter electrode and said electrode holding part such that said counter electrode is capable of generating an electric field for generating ions in cooperation with said electrode needle and is the shortest distance between circumferential edges of the openings of said counter electrode and said electrode holding parts protruding from the openings.

8. The ion generating apparatus as claimed in claim 7, wherein said counter electrode comprises a metal plate in a substantially U-shape cross section having a substantially same length as said elongated body part, wherein both sides of the metal plate having a U-shape are in contact with said body part.

9. The ion generating apparatus as claimed in claim 1, wherein said counter electrode is arranged at a position opposite to an ion radiation direction of said electrode needle.

10. The ion generating apparatus as claimed in claim 1, wherein the surface discharge restraining part is pleat-shaped.

* * * * *